US005585337A

United States Patent [19]

Day et al.

[11] Patent Number: 5,585,337

[45] Date of Patent: Dec. 17, 1996

[54] HYDROCARBON OIL COMPOSITIONS HAVING IMPROVED COLD FLOW PROPERTIES

[75] Inventors: Janet A. Day, Faversham, England; Marinus J. Reynhout; Henricus P. M. Tomassen, both of Amsterdam, Netherlands

[73] Assignee: Shell Oil Company, Houston, Tex.

[21] Appl. No.: 408,741

[22] Filed: Mar. 21, 1995

[51] Int. Cl.[6] ..... C10M 145/16; C10M 145/14

[52] U.S. Cl. ..... 508/466; 508/472

[58] Field of Search ..... 252/56 D, 56 R

[56] References Cited

U.S. PATENT DOCUMENTS

| | | |
|---|---|---|
| 3,143,513 | 4/1964 | Day et al. . |
| 3,419,365 | 12/1968 | Streets . |

FOREIGN PATENT DOCUMENTS

| | | |
|---|---|---|
| 1130232 | 8/1978 | Canada . |
| 061895B2 | 3/1982 | European Pat. Off. . |
| 356256 | 2/1990 | European Pat. Off. . |
| 359061 | 3/1990 | European Pat. Off. . |
| 485774 | 10/1991 | European Pat. Off. . |
| 485773A1 | 10/1991 | European Pat. Off. . |
| 485774A1 | 10/1991 | European Pat. Off. . |
| 636637 | 2/1995 | European Pat. Off. . |
| 2344625 | 3/1977 | France . |
| 1205594 | 10/1967 | United Kingdom . |
| 2065676 | 7/1981 | United Kingdom . |
| 2082604 | 3/1982 | United Kingdom . |

*Primary Examiner*—Jacquelin V. Howard

[57] ABSTRACT

This invention provides hydrocarbon oil compositions comprising a major amount of a hydrocarbon oil and, as active ingredients, minor amounts of a copolymer of at least one n-($C_8$–$C_{40}$-alkyl) (meth)acrylate with maleic anhydride, and at least one additive selected from the group consisting of a homopolymer or copolymer derived from an unsaturated hydrocarbon monomer, an ester and a wax anti-settling additive; additive concentrates containing the active ingredients and use of the latter in improving the cold flow properties of hydrocarbon oils.

17 Claims, No Drawings

HYDROCARBON OIL COMPOSITIONS HAVING IMPROVED COLD FLOW PROPERTIES

FIELD OF THE INVENTION

The present invention relates to hydrocarbon oil compositions and additive concentrates containing mixtures of alkyl (meth)-acrylate polymers and use of the mixtures in improving the cold flow properties of hydrocarbon oils.

BACKGROUND OF THE INVENTION

Hydrocarbon oils such as gas oils, diesel oils, fuel oils, lubricating oils and crude oils contain varying amounts of paraffins. The proportion of long chain n-paraffins, in particular, determines the cold-flow behavior of the oils. On cooling, the n-paraffins separate out as plate-like crystals which interact together to form a three-dimensional network in which still liquid oil becomes trapped, resulting in increased oil viscosity and decreased oil flowability. In gas oil and diesel oil applications, this phenomenon results in filter blockage, whereas in crude oil applications, it results in the gellation of the crude oil and the formation of deposits in pipelines and storage tanks leading to considerable losses in production and capacity.

It is well known that these problems can be alleviated by the addition of so-called flow improvers to such oils.

EP-B2-61,895 discloses the use, as a cold flow improver additive for distillate fuel oil boiling in the range 120° to 500° C., of from 0.0001 to 0.05 wt % based on the weight of the fuel of polyoxyalkylene esters, ethers, ester/ethers or mixtures thereof containing at least two $C_{10}$ to $C_{30}$ linear saturated alkyl groups and a polyoxyalkylene glycol of molecular weight 200 to 2,000, the alkylene group of said polyoxyalkylene glycol containing from 1 to 4 carbon atoms.

U.S. Pat. No. 3,419,365 discloses a composition suitable for use as a fuel, said composition containing a liquid hydrocarbon distillate and a small amount effective to act as a pour point depressant and/or a thermal degradation inhibitor of a hydrogenated styrene-butadiene random or block copolymer additive having a molecular weight in the approximate range 2,000 to 200,000. The examples of this document illustrate the pour point depressant activity of only hydrogenated styrene-butadiene random copolymers.

CA-A-1,130,232 describes a method for dewaxing a hydrocarbon oil which comprises adding thereto a filter aid comprising (a) 5 to 95 parts by weight of an ester polymer of a $C_{13}$–$C_{30}$-alkyl (meth)acrylate having an average molecular weight of 300,000 to 2,000,000, and (b) 5 to 95 parts by weight of an olefin/vinyl acetate copolymer containing 15 to 40 wt. % vinyl acetate and having an average molecular weight of 50,000 to 1,000,000, in an amount of approximately 0.005 to 0.5 wt. % based on hydrocarbon oil, and filtering the hydrocarbon oil.

The process is said to be able to improve the yield of dewaxed hydrocarbon stock without developing haze with the passage of time.

EP-A-485,773 discloses petroleum middle distillates containing small amounts of (A) known flow-improvers based on ethylene, preferably copolymers of ethylene with vinyl acetate, or vinyl propionate or ethylhexyl acrylate, and (B) copolymers consisting of 10 to 95 mol % of one or more alkyl acrylates or alkyl methacrylates with $C_1$- to C26-alkyl chains and of 5 to 90 mol % of one or more ethylenically unsaturated dicarboxylic acids or their anhydrides, the copolymer having been extensively reacted with one or more primary or secondary amines to give the monoamide or amide/ammonium salt of the dicarboxylic acid.

The copolymers B contain from 10 to 95, preferably 40 to 95, and most preferably 60 to 90, mol % of the one or more alkyl (meth)acrylates and from 5 to 90, preferably 5 to 60, and most preferably 10 to 40, mol % of the one or more ethylenically unsaturated dicarboxylic acids or anhydrides.

The alkyl groups of the alkyl (meth)acrylates are said to contain from 1 to 26, preferably 4 to 22, and most preferably 8 to 18, carbon atoms. The alkyl groups are preferably straight-chained and unbranched. However, up to 20% w of cyclic and/or branched alkyl components may be present.

Examples of particularly preferred alkyl (meth)acrylates are listed as n-octyl (meth)acrylate, n-decyl (meth)acrylate, n-dodecyl (meth)acrylate, n-tetradecyl (meth)acrylate, n-hexadecyl (meth)acrylate and n-octadecyl (meth)acrylate and mixtures of these.

Examples of ethylenically unsaturated dicarboxylic acids are said to be maleic acid, tetrahydrophthalic acid, citraconic acid and itaconic acid and their anhydrides as well as fumaric acid. Maleic anhydride is preferred.

The weight ratio of A to B is between 40:60 and 95:5, preferably between 60:40 and 95:5 and most preferably between 70:30 and 90:10.

In the table on Pages 9 to 11 of EP-A-485,773, the cold filter plugging points (CFPPs) for four middle distillates containing components A and B are shown. Underneath the table at Page 11, lines 20 to 23, it is noted that component A alone shows unsatisfactory effects in the middle distillates whilst component B alone actually worsens the CFPP. However, the combination of A with B gives rise to a synergistic reduction in CFPP.

EP-A-485,774 discloses petroleum middle distillates containing small amounts of (A) known flow improvers based on ethylene, preferably copolymers of ethylene with vinyl acetate or vinyl propionate or ethylhexyl acrylate, and (B) copolymers consisting of (a) 10 to 90, preferably 40 to 90, and especially 60 to 90, mol % of one or more alkyl acrylates or alkyl methacrylates with $C_1$- to $C_{30}$-alkyl chains, (b) 5 to 60, preferably 5 to 40, and especially 10 to 30, mol % of one or more ethylenically unsaturated dicarboxylic acids or their anhydrides, and (c) 5 to 60, preferably 5 to 40, and especially 10 to 30, mol % of one or more alkyl vinylethers with $C_{18}$- to $C_{28}$-alkyl side chains.

The alkyl groups of the alkyl (meth)acrylates are said to contain from 1 to 30, preferably 4 to 22, and most preferably 8 to 18, carbon atoms. The alkyl groups are preferably straight-chained and unbranched. However, up to 20% w of cyclic and/or branched alkyl components may be present.

Examples of particularly preferred alkyl (meth)acrylates are listed as n-octyl (meth)acrylate, n-decyl (meth)acrylate, n-dodecyl (meth)acrylate, n-tetradecyl (meth)acrylate, n-hexadecyl (meth)acrylate and n-octadecyl (meth)acrylate and mixtures of these.

Examples of ethylenically unsaturated dicarboxylic acids are said to be maleic acid, tetrahydrophthalic acid, citraconic acid, itaconic acid and their anhydrides, fumaric acid and mixtures of these. Maleic anhydride is preferred.

The alkyl vinylethers are exemplified by octadecyl vinylether, eicosyl vinylether, docosyl vinylether, tetracosyl vinylether, hexacosyl vinylether, octacosyl vinylether and mixtures thereof.

The weight ratio of A to B is between 40:60 and 95:5, preferably between 60:40 and 95:5 and most preferably between 70:30 and 90:10.

The cold filter plugging points (CFPPs) of middle distillates containing components A and B are presented in the table on Pages 11 and 12 of EP-A-485,774.

As noted in the text at Page 12, lines 35 to 38, although component A alone does not produce a very satisfactory result, component B alone actually worsens the CFPP. However, by combining A with B, a synergistic reduction in CFPP is observed.

SUMMARY OF THE INVENTION

It has now surprisingly been found that copolymers of n-alkyl (meth)acrylates and maleic anhydride in combination with certain other additives show advantageous flow improver activity in a range of hydrocarbon oils. Therefore, in accordance with the present invention, there is provided a hydrocarbon oil composition comprising a major amount (more than 50% w) of a hydrocarbon oil and, as active ingredients, minor amounts of a copolymer of at least one n-($C_8$–$C_{40}$-alkyl) (meth)acrylate with maleic anhydride, and at least one additive selected from the group consisting of a homopolymer or copolymer derived from an unsaturated hydrocarbon monomer, an ester and a wax anti-settling additive.

DETAILED DESCRIPTION OF THE INVENTION

The present invention includes a hydrocarbon oil composition comprising a major amount (more than 50% w) of a hydrocarbon oil and, as active ingredients, minor amounts of a copolymer of at least one n-($C_8$–$C_{40}$-alkyl) (meth)acrylate with maleic anhydride, and at least one additive selected from the group consisting of a homopolymer or copolymer derived from an unsaturated hydrocarbon monomer, an ester and a wax anti-settling additive.

The (meth)acrylate/maleic anhydride copolymer (additive (i)) is preferably a copolymer prepared from one or more n-($C_8$–$C_{30}$-alkyl) (meth)acrylates, more preferably one or more n-($C_9$–C25-alkyl) (meth)acrylates, and especially one or more n-($C_9$–$C_{22}$-alkyl) (meth)acrylates. Acrylates are most preferred.

The number average molecular weight ($M_n$) of the copolymer may vary within wide limits. For example, the copolymer may have a number average molecular weight in the range from 500 to 100,000, preferably from 1,000 to 50,000, more preferably from 2,000 to 35,000, still more preferably from 3,000 to 20,000, and advantageously from 4,000 to 12,000. The number average molecular weight may conveniently be determined by gel permeation chromatography (GPC) against polystyrene standards.

Processes for the preparation of copolymers of alkyl (meth)acrylates with maleic anhydride are well known in the art and are described in, for example, EP-A-485,773, EP-A-485,774 and U.S. Pat. No. 4,663,491.

Particularly advantageous results are obtained when the copolymer has a structure consisting substantially of alternating (meth)acrylate and maleic anhydride monomeric units (i.e. a degree of alternation of at least 85%). Such a highly alternating copolymer is known from, and prepared by the process of, U.S. Patent application Ser. No. 08/280,631 filed Jul. 26, 1994 (T-6577) which claims priority of European Patent Application No. 93305917.2 filed 27 Jul. 1993. In this process, a predetermined molar amount of at least one n-($C_8$–$C_{30}$-alkyl) (meth)acrylate is dosed to a predetermined molar amount of maleic anhydride at a dosage rate of 20 to 100 mol % (meth)acrylate per hour, the ratio of the predetermined molar amount of (meth)acrylate to the predetermined molar amount of maleic anhydride being in the range from 1:1 to 1:5. The reaction is carried out in the presence of a radical-forming initiator such as alpha,alpha'-azoisobutyronitrile (AIBN) and conveniently also in a solvent such as toluene.

The homopolymer or, preferably, copolymer derived from an unsaturated hydrocarbon monomer (additive (ii)) may be hydrogenated, e.g. partially (selectively) or fully.

The number average molecular weight ($M_n$) of the homopolymer or copolymer may vary within wide limits. For example, it may have a number average molecular weight in the range from 500 to 500,000, preferably from 1,000 to 150,000, more preferably from 2,000 to 100,000 and especially from 10,000 to 100,000. The number average molecular weight may conveniently be determined by gel permeation chromatography (GPC) against polystyrene standards.

The unsaturated hydrocarbon monomer preferably contains from 2 to 20, more preferably 2 to 12, and particularly 2 to 8, carbon atoms. The monomer may be aliphatic or aromatic.

Examples of unsaturated hydrocarbon monomers include ethylene, propylene, 1-butene, isobutene, 1,3-butadiene, isoprene, 1-hexene, 1-octene, 1-decene, 1-dodecene, 1-tetradecene, 1-hexadecene, 1-octadecene, styrene, alpha-methylstyrene, 3-methylstyrene, 4-methylstyrene and 2-vinylnaphthalene. Ethylene, 1,3-butadiene and styrene are particularly preferred.

When additive (ii) is a copolymer, this may be derived from two or more different unsaturated hydrocarbon monomers or may be partly derived from other monomers such as vinylpyridines (e.g. 2-vinylpyridine and 4-vinylpyridine), alkyl esters of acrylic and methacrylic acids (e.g. 2-ethylhexyl acrylate, methyl methacrylate, dodecyl methacrylate, octadecyl methacrylate), and vinyl esters of carboxylic acids (e.g. vinyl acetate and vinyl stearate).

Additive (ii) is preferably an ethylene/vinyl acetate copolymer or a hydrogenated styrene/butadiene copolymer.

Ethylene/vinyl acetate copolymers having a vinyl acetate content of up to 40% are commercially available from the Aldrich Chemical Company Ltd., U.K.

Examples of hydrogenated styrene/butadiene copolymers useful in the present invention are those sold by member companies of the Royal Dutch/Shell Group under the trade mark "KRATON".

The ester (additive (iii)) is preferably an ester obtained by the reaction of a $C_2$–$C_{30}$, preferably $C_2$–$C_{20}$, and especially C4–$C_{18}$, carboxylic acid with an alcohol, e.g. a monoalcohol such as a $C_2$–$C_{30}$ alkanol, in particular a $C_{21}$ alkanol (e.g. behenyl alcohol) or the $C_9$–$C_{15}$ linear alkanols commercially available from member companies of the Royal Dutch/Shell Group under the trade mark "DOBANOL", or a polyalcohol such as glycerol, erythritol or a polyoxyalkylene glycol as described in EP-B2-61,895.

Examples of carboxylic acids include malic acid, succinic acid and $C_{10}$–$C_{30}$ fatty acids, particularly stearic acid and behenic acid.

The most preferred esters are those obtained by reacting malic acid with a $C_{21}$ alkanol, and stearic acid with each of glycerol and erythritol.

Examples of wax anti-settling additives (additive iv)) are those commercially available under the trade marks "PARAFLOW" (e.g. "PARAFLOW" 450; ex PARAMINS), "OCTEL" (e.g. "OCTEL" W 5000; ex OCTEL) and "DODIFLOW" (e.g. "DODIFLOW" V 3958; ex HOECHST). "PARAFLOW" (trade mark) 450 wax anti-settling additive is particularly preferred for use in the present invention.

Combinations of additive (i) with one or more of additives (ii), (iii) and (iv) can advantageously be used to improve the cold flow properties of hydrocarbon oils such as gas oils, diesel oils, fuel oils, lubricating oils and crude oils. Conveniently, in the hydrocarbon oil composition of the invention, the active ingredients together are present in an amount of 1 to 2000 mg per kg hydrocarbon oil, i.e. the total amount of active matter is in the range from 1 to 2000 mg per kg hydrocarbon oil. Preferably, the active ingredients together are present in an amount of from 5 to 1000, more preferably from 10 to 500, still more preferably from 10 to 200, and in particular from 50 to 200, mg (active matter) per kg hydrocarbon oil.

The weight ratio of additive (i) to additive (ii) is preferably in the range from 10:1 to 1:10, more preferably from 10:1 to 1:5, and especially from 6:1 to 1:2.

The weight ratio of additive (i) to additive (iii) is preferably in the range from 10:1 to 1:10, more preferably from 5:1 to 1:5, and especially from 1:1 to 1:2.

The weight ratio of additive (i) to additive (iv) is preferably in the range from 10:1 to 1:10, more preferably from 5:1 to 1:5, and especially from 1:1 to 1:4.

The hydrocarbon oil composition according to the invention may be prepared by adding the active ingredients separately to a hydrocarbon oil. Thus, the active ingredients per se or, more preferably, solutions thereof (the solutions each containing e.g. 50% w active ingredient) are added in a calculated, desired amount to the hydrocarbon oil. Solvents suitable for preparing the solutions include ether solvents such as tetrahydrofuran and dioxan; alcohols such as butanol; and hydrocarbon solvents such as toluene, xylene, ethylbenzene, hexane, octane, cyclohexane and those sold by member companies of the Royal Dutch/Shell Group under the trade mark "SHELLSOL".

The hydrocarbon oil composition however is conveniently prepared by blending an additive concentrate with a hydrocarbon oil. Accordingly, the present invention further provides an additive concentrate comprising an inert carrier fluid and, as active ingredients, a copolymer of at least one n-($C_8$–$C_{40}$-alkyl) (meth)acrylate with maleic anhydride, and at least one additive selected from the group consisting of a homopolymer or copolymer derived from an unsaturated hydrocarbon monomer, an ester and a wax anti-settling additive, the active ingredients together comprising from 10 to 80% w of the concentrate.

The inert carrier fluid is conveniently a hydrocarbon solvent such as toluene, xylene or those sold by member companies of the Royal Dutch/Shell Group under the trade mark "SHELLSOL". Alternatively, the carrier fluid may be a mineral base oil such as those sold by member companies of the Royal Dutch/Shell Group under the designations "HVI" or "XHVI" (trade mark).

The hydrocarbon oil compositions may, depending on their end-use, contain various other additives such as dispersants, detergents, corrosion inhibitors and viscosity-index improvers.

The present invention still further provides the use of a copolymer of at least one n-($C_8$–$C_{40}$-alkyl) (meth)acrylate with maleic anhydride, together with at least one additive selected from the group consisting of a homopolymer or copolymer derived from an unsaturated hydrocarbon monomer, an ester and a wax anti-settling additive, for improving the cold flow properties of a hydrocarbon oil.

The present invention will be further understood from the following illustrative example. In this example, unless otherwise stated, the number average and weight average molecular weights quoted were determined by gel permeation chromatography against polystyrene standards.

EXAMPLES

Solutions of four acrylate/maleic anhydride (MALA) copolymers (designated MA 1, MA 2, MA 3 and MA 4) in toluene were prepared, each of which contained 50% w copolymer (50% w active matter). MA 1 was a highly alternating copolymer of $C_{12}$–$C_{15}$-alkyl acrylate and maleic anhydride having a number average molecular weight: ($M_n$) of 7,700 and a degree of alternation of 90%. MA 1 corresponds to the copolymer of Example 1 of U.S. patent application Ser. No. 08/280,631 filed Jul. 26, 1994 (T-6577) which claims priority of European Patent Application No. 93305917.2 filed 27 Jul. 1993. MA 2 was a highly alternating copolymer of $C_{12}$–$C_{15}$-alkyl acrylate and maleic anhydride prepared by a process similar to that of MA 1. MA 2 had a number average molecular weight of 7,200 and a degree of alternation of 96%. MA 3 was a copolymer of $C_{22}$-alkyl acrylate and maleic anhydride prepared in conventional manner, having a number average molecular weight of 10,900 and a degree of alternation of 53%. MA 4 was a copolymer of $C_9$–$C_{12}$-alkyl acrylate and maleic anhydride prepared in conventional manner, having a number average molecular weight of 5,900 and a degree of alternation of 80%.

In a similar manner, 50% w solutions (50% w active matter) of the following additives in toluene were prepared, with the exception of additive (2) which was used directly:

(1) ethylene/vinyl acetate (EVA) copolymer (vinyl acetate content 25%; $M_n$ 31,000; ex ALDRICH);

(2) "PARAFLOW" (trade mark) 450 wax anti-settling additive (PAR 450) (ex PARAMINS)—GPC analysis of this product indicates solid matter comprising polymer of $M_n$ 23,000 and low that it contains approximately 22% aromatic solvent and 78% molecular weight active components;

(3) di–$C_{21}$ malic acid ester (ES 1), being the diester formed between malic acid and behenyl alcohol;

(4) glyceroltristearate (ES 2);

(5) erythritoltetrastearate (ES 3);

(6) KRATON® G 1650 styrene/butadiene copolymer (SB 1) containing 29% w polystyrene and having the formula S-B-S where S represents a polystyrene block of weight average molecular weight ($M_w$) 7,500, and B represents a hydrogenated polybutadiene block of weight average molecular weight 86,000, in which at least 90% of the original unsaturation has been hydrogenated (ex SHELL); and (7) KRATON® G 1652 styrene/butadiene copolymer (SB 2) containing 29.5% w polystyrene and having the formula S-B-S where S represents a polystyrene block of weight average molecular weight 9,900, and B represents a hydrogenated polybutadiene block of weight average molecular weight 63,000, in which at least 90% of the original unsaturation has been hydrogenated (ex SHELL).

Combinations of the acrylate/maleic anhydride-containing solutions and the additive-containing solutions were incorporated into a range of gas oils (designated a, b, c, d and e) preheated to 50° C. and the cold filter plugging points (CFPP) of the resulting compositions determined according to standard test method IP 309/83.

Gas oil a was a German automotive gas oil having density at 15° C. of 836 kg/m$^3$, viscosity at 40° C. of 3.17 mm$^2$/s, sulphur content of 0.11% w and a boiling point range: 10%=204° C. 50%=259° C. and 90%=324° C. Gas oil b was a German automotive gas oil having density at 15° C. of 843 kg/m$^3$, sulphur content of 0.18% w and a boiling point range: 10%=229° C., 50%=279° C. and 90%=345° C. Gas oil c was a French industrial gas oil having density at 15° C. of 853 kg/m$^3$, viscosity at 40° C. of 3.82 mm$^2$/s and sulphur content of <0.3% w. Gas oil d was a French automotive gas oil having density at 15° C. of 841 kg/m$^3$, viscosity at 40° C. of 3.46 mm$^2$/s and sulphur content of <0.5% w. Gas oil e was a Dutch automotive gas oil having density at 15° C. of 834 kg/m$^3$, viscosity at 40° C. of 2.38 mm$^2$/s, sulphur content of 0.12% w and a boiling point range: 10%=198° C., 50%=252° C. and 90%=326° C.

Gas oils a to e had aromatic contents in the region of 20 to 30% w.

The CFPP values obtained are shown in Table I below. In this table, the amount of copolymer solution or additive solution added to the gas oil is expressed as mg polymer solution or mg additive solution per kg gas oil ("solution mg/kg"). Furthermore, Table I also includes the results of several comparative tests (Comparative Examples A to AB) which were carried out (see test numbers 1 to 5, 10, 14, 17, 19, 21, 24 to 26, 28 to 30, 32, 34 to 36, 38, 41 to 43, 47 and 48).

It can clearly be seen from the data presented in Table I that the hydrocarbon oil compositions of the invention (Examples I to XXVI) demonstrate very advantageous cold flow properties. Indeed, the data clearly show that the combinations of additives used produced a synergistic reduction in CFPP in each of the various gas oils tested.

TABLE I

| Test No. | Ex. No. | Gas Oil | Acr./MALA copolymer (solution mg/kg) | Solution mg/kg EVA | PAR 450 | ES 1 | ES 2 | ES 3 | SB 1 | SB 2 | CFPP (°C.) |
|---|---|---|---|---|---|---|---|---|---|---|---|
| 1 | Comp A | a | — | — | — | — | — | — | — | — | −10 |
| 2 | Comp B | a | MA 1 (300) | — | — | — | — | — | — | — | −19 |
| 3 | Comp C | a | MA 1 (500) | — | — | — | — | — | — | — | −20 |
| 4 | Comp D | a | — | 75 | — | — | — | — | — | — | −17 |
| 5 | Comp E | a | — | 300 | — | — | — | — | — | — | −18 |
| 6 | I | a | MA 1 (75) | 75 | — | — | — | — | — | — | −21 |
| 7 | II | a | MA 1 (125) | 25 | — | — | — | — | — | — | −28 |
| 8 | III | a | MA 1 (150) | 25 | — | — | — | — | — | — | −31 |
| 9 | IV | a | MA 1 (200) | 100 | — | — | — | — | — | — | −30 |
| 10 | Comp F | a | MA 2 (300) | — | — | — | — | — | — | — | −16 |
| 11 | V | a | MA 2 (100) | 50 | — | — | — | — | — | — | −20 |
| 12 | VI | a | MA 2 (75) | 75 | — | — | — | — | — | — | −18 |
| 13 | VII | a | MA 2 (75) | 75 | — | — | 100 | — | — | — | −24 |
| 14 | Comp G | a | — | — | — | 300 | — | — | — | — | −15 |
| 15 | VIII | a | MA 2 (100) | 50 | — | 100 | — | — | — | — | −25 |
| 16 | IX | a | MA 2 (100) | 100 | — | 100 | — | — | — | — | −26 |
| 17 | Comp H | a | — | — | — | — | — | — | 300 | — | −12 |
| 18 | X | a | MA 2 (150) | — | — | — | — | — | 150 | — | −18 |
| 19 | Comp J | a | — | — | — | — | — | — | — | 300 | −13 |
| 20 | XI | a | MA 2 (150) | — | — | — | — | — | — | 150 | −17 |
| 21 | Comp K | a | MA 4 (150) | — | — | — | — | — | — | — | −11 |
| 22 | XII | a | MA 4 (75) | 75 | — | — | — | — | — | — | −18 |
| 23 | XIII | a | MA 4 (50) MA 2 (50) | 75 | — | — | — | — | — | — | −20 |
| 24 | Comp L | b | — | — | — | — | — | — | — | — | −2 |
| 25 | Comp M | b | MA 3 (300) | — | — | — | — | — | — | — | −3 |
| 26 | Comp N | b | — | 300 | — | — | — | — | — | — | −9 |
| 27 | XIV | b | MA 3 (150) | 150 | — | — | — | — | — | — | −11 |
| 28 | Comp P | c | — | — | — | — | — | — | — | — | −17 |
| 29 | Comp Q | c | MA 1 (300) | — | — | — | — | — | — | — | −20 |
| 30 | Comp R | c | — | 300 | — | — | — | — | — | — | −17 |
| 31 | XV | c | MA 1 (150) | 150 | — | — | — | — | — | — | −22 |
| 32 | Comp S | c | — | — | 300 | — | — | — | — | — | −21 |
| 33 | XVI | c | MA 1 (150) | — | 150 | — | — | — | — | — | −25 |
| 34 | Comp T | d | — | — | — | — | — | — | — | — | −4 |
| 35 | Comp U | d | MA 1 (300) | — | — | — | — | — | — | — | −9 |
| 36 | Comp V | d | — | 300 | — | — | — | — | — | — | −5 |
| 37 | XVII | d | MA 1 (150) | 150 | — | — | — | — | — | — | −12 |
| 38 | Comp W | d | — | — | 300 | — | — | — | — | — | −11 |
| 39 | XVIII | d | MA 1 (150) | — | 150 | — | — | — | — | — | −17 |
| 40 | XIX | d | MA 1 (75) | 75 | 150 | — | — | — | — | — | −15 |
| 41 | Comp X | e | — | — | — | — | — | — | — | — | −9 |
| 42 | Comp Y | e | MA 2 (300) | — | — | — | — | — | — | — | −10 |
| 43 | Comp Z | e | — | 300 | — | — | — | — | — | — | −17 |
| 44 | XX | e | MA 2 (75) | 75 | — | — | — | — | — | — | −18 |
| 45 | XXI | e | MA 2 (100) | 50 | — | — | — | — | — | — | −25 |
| 46 | XXII | e | MA 2 (125) | 125 | — | — | — | — | — | — | −24 |
| 47 | Comp AA | e | — | — | — | 300 | — | — | — | — | −14 |
| 48 | Comp AB | e | — | 150 | — | 150 | — | — | — | — | −15 |
| 49 | XXIII | e | MA 2 (50) | 100 | — | 100 | — | — | — | — | −27 |
| 50 | XXIV | e | MA 2 (75) | 75 | — | 100 | — | — | — | — | −26 |
| 51 | XXV | e | MA 2 (75) | 75 | — | — | 100 | — | — | — | −27 |
| 52 | XXVI | e | MA 2 (75) | 75 | — | — | — | 100 | — | — | −26 |

We claim:

1. A hydrocarbon oil composition comprising:

a major amount of a hydrocarbon oil;

a first active ingredient comprising a copolymer of at least one n-($C_8$–$C_{40}$-alkyl) (meth)acrylate with maleic anhydride; and a second active ingredient comprising a cold flow property improving amount of one or more additives selected from the group consisting of (i) homopolymer or copolymer derived from one or more unsaturated hydrocarbon monomers, (ii) ester, and (iii) wax anti-settling additive;

wherein the first and second active ingredients together are present in an amount of from about 1 mg to about 2000 mg per kg of the hydrocarbon oil.

2. The composition according to claim 1, wherein the (meth)acrylate is a n-($C_8$–$C_{30}$-alkyl) (meth)acrylate.

3. The composition according to claim 2, wherein the (meth)acrylate is a n-($C_9$–$C_{22}$-alkyl) (meth)acrylate.

4. The composition according to claim 1, wherein the unsaturated hydrocarbon monomer contains from 2 to 20 carbon atoms.

5. The composition according to claim 4, wherein the second active ingredient is a copolymer and the an unsaturated hydrocarbon monomer contains from 2 to 12 carbon atoms.

6. The composition according to claim 4, wherein the unsaturated hydrocarbon monomer is selected from ethylene, 1,3-butadiene, and styrene.

7. The composition according to claim 1, wherein the ester is obtained by reaction of a $C_2$–$C_{30}$ carboxylic acid with an alcohol.

8. The composition according to claim 7, wherein the alcohol is a $C_2$–$C_{30}$ alkanol, glycerol, or erythritol.

9. The composition according to claim 1, wherein the first and second active ingredients together are present in an amount of from about 5 mg to about 1000 mg per kg of the hydrocarbon oil.

10. An additive concentrate comprising:

an inert carrier fluid; and a copolymer of at least one n-($C_8$–$C_{40}$-alkyl) (meth)acrylate with maleic anhydride as a first active ingredient; and at least one additive as a second active ingredient selected from the group consisting of (i) homopolymer or copolymer derived from one or more unsaturated hydrocarbon monomers, (ii) ester, and (iii) wax anti-settling additive;

the first and second active ingredients together comprising from 10 to 80% w of the concentrate.

11. A method for improving the cold flow properties of a hydrocarbon oil, said method comprising admixing a hydrocarbon oil, a copolymer of at least one n-($C_8$–$C_{40}$-alkyl) (meth)acrylate with maleic anhydride, and at least one additive selected from the group consisting of (i) homopolymer or copolymer derived from one or more unsaturated hydrocarbon monomers, (ii) ester, and (iii) wax anti-settling additive.

12. The composition according to claim 1, wherein the first and second active ingredients together are present in an amount of from about 10 mg to about 500 mg per kg of the hydrocarbon oil.

13. The composition according to claim 1, wherein the first and second active ingredients together are present in an amount of from about 10 mg to about 200 mg per kg of the hydrocarbon oil.

14. The composition according to claim 1, wherein the first and second active ingredients together are present in an amount of from about 50 mg to about 200 mg per kg of the hydrocarbon oil.

15. A hydrocarbon oil composition exhibiting improved cold flow properties, comprising:

(a) a major amount of hydrocarbon oil;

(b) as a first active ingredient, at least one copolymer of maleic anhydride with at least one n-($C_8$–$C_{40}$-alkyl) (meth)acrylate; and (c) as a second active ingredient, at least one additive selected from the group consisting of homopolymers and copolymers derived from one or more unsaturated hydrocarbon monomers;

wherein the first and second active ingredients together are present in the amount of from about 1 mg to about 2000 mg per kg of the hydrocarbon oil, and wherein the weight ratio of the first active ingredient to the second active ingredient is in the range of from about 10:1 to 1:10.

16. A hydrocarbon oil composition exhibiting improved cold flow properties, comprising:

(a) a major amount of hydrocarbon oil;

(b) as a first active ingredient, at least one copolymer of maleic anhydride with at least one n-($C_8$–$C_{40}$-alkyl) (meth)acrylate; and (c) as a second active ingredient, one or more esters;

wherein the first and second active ingredients together are present in the amount of from about 1 mg to about 2000 mg per kg of the hydrocarbon oil, and wherein the weight ratio of the first active ingredient to the second active ingredient is in the range of from about 10:1 to 1:10.

17. A hydrocarbon oil composition exhibiting improved cold flow properties, comprising:

(a) a major amount of hydrocarbon oil;

(b) as a first active ingredient, at least one copolymer of maleic anhydride with at least one n-($C_8$–$C_{40}$-alkyl) (meth)acrylate; and (c) as a second active ingredient, one or more wax-settling additives;

wherein the first and second active ingredients together are present in the amount of from about 1 mg to about 2000 mg per kg of the hydrocarbon oil, and wherein the weight ratio of the first active ingredient to the second active ingredient is in the range of from about 10:1 to 1:10.

* * * * *